US007390351B2

(12) United States Patent
Leir et al.

(10) Patent No.: US 7,390,351 B2
(45) Date of Patent: Jun. 24, 2008

(54) ELECTRETS AND COMPOUNDS USEFUL IN ELECTRETS

(75) Inventors: Charles M. Leir, Falcon Heights, MN (US); Rahul R. Shah, Woodbury, MN (US); Karl E. Benson, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 344 days.

(21) Appl. No.: 11/276,015

(22) Filed: Feb. 9, 2006

(65) Prior Publication Data

US 2007/0180997 A1 Aug. 9, 2007

(51) Int. Cl.
*B03C 3/28* (2006.01)

(52) U.S. Cl. ..... 96/15; 55/528; 55/DIG. 5; 55/DIG. 33; 55/DIG. 35; 55/DIG. 39; 95/57; 96/69; 442/349; 442/414

(58) Field of Classification Search ..... 96/15, 96/17, 66, 69; 55/524, 527, 528, DIG. 5, 55/DIG. 33, DIG. 35, DIG. 39; 95/57, 59; 442/349, 414; 307/400; 29/886; 264/DIG. 48
See application file for complete search history.

(56) References Cited

U.S. PATENT DOCUMENTS

| | | | | |
|---|---|---|---|---|
| 4,626,263 | A | 12/1986 | Inoue et al. | |
| 4,789,504 | A | 12/1988 | Ohmori et al. | |
| 5,025,052 | A | 6/1991 | Crater et al. | |
| 5,057,710 | A | 10/1991 | Nishiura et al. | |
| 5,099,026 | A | 3/1992 | Crater et al. | |
| 5,472,481 | A | 12/1995 | Jones et al. | |
| 5,554,722 | A | 9/1996 | Eichenauer et al. | |
| 5,558,809 | A | 9/1996 | Groh et al. | |
| 5,871,845 | A | 2/1999 | Dahringer et al. | |
| 5,908,598 | A | 6/1999 | Rousseau et al. | |
| 5,968,635 | A | 10/1999 | Rousseau et al. | |
| 5,976,208 | A | 11/1999 | Rousseau et al. | |
| 6,002,017 | A | 12/1999 | Rousseau et al. | |
| 6,110,251 | A | 8/2000 | Jackson et al. | |
| 6,156,086 | A * | 12/2000 | Zhang | 55/382 |
| 6,238,466 | B1 * | 5/2001 | Rousseau et al. | 96/15 |

(Continued)

FOREIGN PATENT DOCUMENTS

EP 620044 A2 * 10/1994

(Continued)

OTHER PUBLICATIONS

Beilstein Registry No. 3515288 Chemical Name: *N,N'*-p-phenylene-bis-stearamide.

(Continued)

*Primary Examiner*—Richard L Chiesa
(74) *Attorney, Agent, or Firm*—Allison Johnson; Karl G. Hanson

(57) ABSTRACT

An electret filter media that includes a thermoplastic resin and a compound of the formula $Y^2$-A$(R^1)_n$—$Y^1$, where A is benzene, naphthalene or anthracene, $Y^1$ and $Y^2$ are each independently $R^2$-$R^3$, $R^2$ is an ester linking group or an amide linking group, $R^3$ is an alkyl group having from 10 to 22 carbon atoms, $R^1$ is $R^2$-$R^3$ where $R^2$ and $R^3$ are each independently as defined above, and when A is benzene, n is from 0 to 4, when A is naphthalene, n is from 0 to 6, and when A is anthracene, n is from 0 to 8.

19 Claims, 2 Drawing Sheets

U.S. PATENT DOCUMENTS

| | | | | |
|---|---|---|---|---|
| 6,284,843 | B1 * | 9/2001 | Jariwala et al. | 525/276 |
| 6,391,807 | B1 * | 5/2002 | Jariwala et al. | 442/327 |
| 6,391,948 | B1 * | 5/2002 | Clark et al. | 524/101 |
| 6,397,458 | B1 | 6/2002 | Jones et al. | |
| 6,432,175 | B1 * | 8/2002 | Jones et al. | 96/15 |
| 6,660,210 | B2 * | 12/2003 | Jones et al. | 264/423 |
| 6,780,226 | B1 * | 8/2004 | Lifshutz et al. | 96/15 |
| 6,926,961 | B2 * | 8/2005 | Roth | 428/364 |
| 2001/0039879 | A1 * | 11/2001 | Chapman | 96/69 |
| 2002/0190434 | A1 | 12/2002 | Eitzman et al. | |
| 2003/0055179 | A1 * | 3/2003 | Ota et al. | 525/242 |
| 2004/0122192 | A1 * | 6/2004 | Imuta et al. | 526/127 |
| 2006/0243139 | A1 * | 11/2006 | Kirk et al. | 96/69 |

FOREIGN PATENT DOCUMENTS

| | | |
|---|---|---|
| WO | WO 00/78430 | 12/2000 |

OTHER PUBLICATIONS

Reaction ID: 764463 Reactant BRN: 742029 benzene-1,4-diamine 639784 octadecanoyl chloride Product BRN: 3515288 *N,N'*-p-phenylene-bis-stearamide.

Reaction ID: 736049 Reactant BRN: 608585 octadecanoic acid 742029 benzene-1,4-diamine Product BRN: 3515288 *N,N'*-p-phenylene-bis-stearamide.

Reaction ID: 3550893 Reactant BRN: 2940936 benzene-1,3,5-tricarbonyl trichloride 636111 octadecylamine Product BRN: 6997468 trioctadecly-1,3,5-benzenetricarboxamide.

* cited by examiner

ELECTRETS AND COMPOUNDS USEFUL IN ELECTRETS

BACKGROUND

The invention relates to preparing electrets and to enhancing release properties of thermoplastic films using resin additives.

The filtration properties of nonwoven polymeric fibrous webs can be improved by transforming the web into an electret, i.e., a dielectric material exhibiting a quasi-permanent electrical charge. Electrets are effective in enhancing particle capture in aerosol filters. Electrets are useful in a variety of devices including, e.g., air filters, face masks, and respirators, and as electrostatic elements in electro-acoustic devices such as microphones, headphones, and electrostatic recorders.

Electrets are currently produced by a variety of methods including direct current ("DC") corona charging (see, e.g., U.S. Pat. Re. 30,782 (van Turnhout)), and hydrocharging (see, e.g., U.S. Pat. No. 5,496,507 (Angadjivand et al.)), and can be improved by incorporating fluorochemicals into the melt used to produce the fibers of some electrets (see, e.g., U.S. Pat. No. 5,025,052 (Crater et al.)) and by plasma fluorinating (see, e.g., U.S. Pat. No. 6,397,458 (Jones et al.)).

Many of the particles and contaminants with which electret filters come into contact interfere with the filtering capabilities of the webs. Liquid aerosols, for example, particularly oily aerosols, tend to cause electret filters to lose their electret enhanced filtering efficiency (see, e.g., U.S. Pat. No. 5,411,576 (Jones et al.)). In addition, heat and aging can impair the filter efficiency of some electret filters.

Numerous approaches have been developed to compensate for loss of filtering efficiency of an electret filter. One method for improving an electret filter's efficiency includes increasing the amount of the nonwoven polymeric web in the electret filter by adding layers of web or increasing the thickness of the electret filter. The additional web, however, increases the breathing resistance of the electret filter, adds weight and bulk to the electret filter, and increases the cost of the electret filter.

Another method for improving an electret filter's resistance to oily aerosols includes forming the electret filter from resins that include melt processable fluorochemical additives such as fluorochemical oxazolidinones, fluorochemical piperazines, and perfluorinated alkanes (see, e.g., U.S. Pat. No. 5,025,052 (Crater et al.)), perfluorinated moieties. The fluorochemicals are melt processable, i.e., suffer substantially no degradation under the melt processing conditions used to form the microfibers that are used in the fibrous webs of some electrets (see, e.g., WO 97/07272 (Minnesota Mining and Manufacturing)). Thermally stable organic traizine compounds also have been used to improve charging of an electret filter (see, e.g., U.S. Pat. No. 5,908,598 (Rousseau et al.) and U.S. Pat. No. 6,002,017 (Rousseau et al.)).

SUMMARY OF THE INVENTION

In one aspect, the invention features an electret filter media that includes a fibrous web having fibers that includes thermoplastic resin, and a compound of the formula $Y^2$-$A(R^1)_n$—$Y^1$ (I) where A is benzene, naphthalene or anthracene, $Y^1$ and $Y^2$ are each independently $R^2$-$R^3$, $R^2$ is an ester linking group or an amide linking group, $R^3$ is a straight chain alkyl group having from 10 to 22 carbon atoms, $R^1$ is $R^2$-$R^3$ where $R^2$ and $R^3$ are each independently as defined above, and when A is benzene, n is from 0 to 4, when A is naphthalene, n is from 0 to 6, and when A is anthracene, n is from 0 to 8. In one embodiment, A is benzene. In some embodiments, $R^2$ is —CONH, —NHCO, —OCO or —COO. In other embodiments, $R^3$ is an alkyl group having from 12 to 22 carbon atoms. In another embodiment, n is 1.

In some embodiments, n is 1, and $R^1$, $Y^1$ and $Y^2$ are located meta to each other. In other embodiments, n is 0 and $Y^1$ and $Y^2$ are located para to each other.

In other embodiments, A is naphthalene.

In other embodiments, $R^3$ is an alkyl group having from 12 to 22 carbon atoms.

In some embodiments, n is 0, $Y^1$ is located at the 2 position on naphthalene, and $Y^2$ is located at the 6 position on naphthalene. In another embodiment, n is 1.

In some embodiments, the compound of formula (I) is selected from the group consisting of benzene-1,3,5-tricarboxylic acid tris-octadecylamide, p-phenylene distearylamide; distearyl-2,6-naphthalenedicarboyxlate, and 2,6-naphthalene distearamide.

In another embodiment, the thermoplastic resin is selected from the group consisting of polycarbonate, polyolefin, polyester, halogenated polyvinyl, polystyrene, or a combination thereof. In some embodiments, the thermoplastic resin is selected from the group consisting of polypropylene, poly-(4-methyl-1-pentene), or a combination thereof.

In one embodiment, the nonwoven web includes melt-blown microfibers.

In some embodiments, the electret filter media is in the form of a filter.

In another aspect, the invention features a method of making a fibrous electret material that includes forming a fibrous web of nonconductive thermoplastic fibers from a thermoplastic composition disclosed herein and charging the web to provide the web with a filtration enhancing electret charge. In some embodiments, the charging includes impinging jets of water or a stream of water droplets on to the web at a pressure sufficient to provide the web with a filtration enhancing electret charge, and drying the web.

In one aspect, the invention features a respirator that includes a filter media that includes an electret filter media disclosed herein.

In another aspect, the invention features a vehicle ventilation system that includes a filter media that includes an electret filter media disclosed herein.

In other aspects, the invention features a thermoplastic composition that includes thermoplastic resin and a compound of formula $Y^2$-$A(R^1)_n$—$Y^1$ (I). In one embodiment, the thermoplastic composition is a release surface. In some embodiments, the release surface is in the form of a self-supporting film.

In one embodiment, a pressure sensitive adhesive tape includes a substrate that includes a release surface disclosed herein and a pressure sensitive adhesive composition disposed on the substrate.

In another aspect, the invention features a method of making a release surface that includes forming a thermoplastic composition that includes a thermoplastic resin and a compound of the formula $Y^2$-$A(R^1)_n$—$Y^1$ (I) into a film.

In other aspects, the invention features a compound of the formula $$Y^2\text{-}A(R^1)_n\text{—}Y^1 \quad \text{(II)}$$

where A is naphthalene or anthracene, $Y^1$ and $Y^2$ are each independently $R^2$-$R^3$, $R^2$ is an ester or an amide, $R^3$ is an alkyl group having from 10 to 22 carbon atoms, $R^1$ is $R^2$-$R^3$ where $R^2$ and $R^3$ are each independently as defined above, and when A is naphthalene, n is from 0 to 6, and when A is anthracene, n is from 0 to 8. In one embodiment, A is naphthalene. In some embodiments, $R^2$ is —CONH—, —NHCO—, —OCO— or —COO—. In some embodiments, $R^3$ is an alkyl group having from 12 to 22 carbon atoms. In other embodiments, n is 0, $Y^1$ is located at the 2 position on naphthalene, and $Y^2$ is located at the 6 position on naphthalene. In some embodiments, n is 1. In other embodiments, A is anthracene.

In some embodiments the compound is of the formula IIa (IIa)

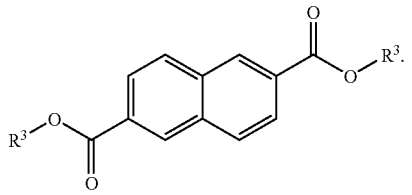

In other embodiments, the compound is of the formula IIb (IIb)

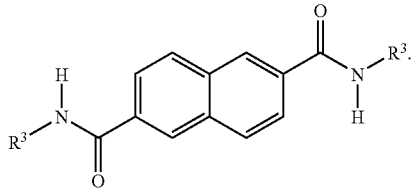

The compound of formula (II) is selected from the group consisting of distearyl-2,6-naphthalenedicarboyxlate and 2,6-naphthalene distearamide.

In other aspects, the invention features a compound of the formula:

$$Y^2\text{-}A(R^1)_n\text{—}Y^1 \quad \text{(III)}$$

where A is benzene, $Y^1$ and $Y^2$ are each independently $R^2$-$R^3$, $R^2$ is an ester or an amide, $R^3$ is an alkyl group having from 10 to 22 carbon atoms, $R^1$ is $R^2$-$R^3$ where $R^2$ and $R^3$ are each independently as defined above, at least one $R^1$ is located meta to at least one of $Y^1$ and $Y^2$, and n is from 1 to 4.

The invention features compounds that can be used to enhance the filtration performance of nonwoven polymeric fiber webs, stabilize the charge present in a nonwoven polymeric fiber web, enhance the charge in an electret film, stabilize the charge in an electret film or a combination thereof. Some of the novel compounds also exhibit thermal stability and impart charge stability to nonwoven polymeric fiber webs. Some of the novel compounds are also useful as release agents for release coatings.

Other features and advantages will be apparent from the following description of the preferred embodiments and from the claims.

GLOSSARY

In reference to the invention, these terms have the meanings set forth below:

The term "alkyl" refers to a fully saturated monovalent straight chain radical having the stated number of carbon atoms containing only carbon and hydrogen.

The term "electret" means a dielectric material exhibiting at least quasi-permanent electrical charge. The term "quasi-permanent" means that the time constants characteristic for the decay of the charge are much longer than the time period over which the electret is used;

The term "aerosol" means a gas that contains suspended particles in solid or liquid form; and The term "contaminants" means particles and/or other substances that generally may not be considered to be particles (e.g., organic vapors).

DETAILED DESCRIPTION OF PREFERRED EMBODIMENTS

Figure 1:
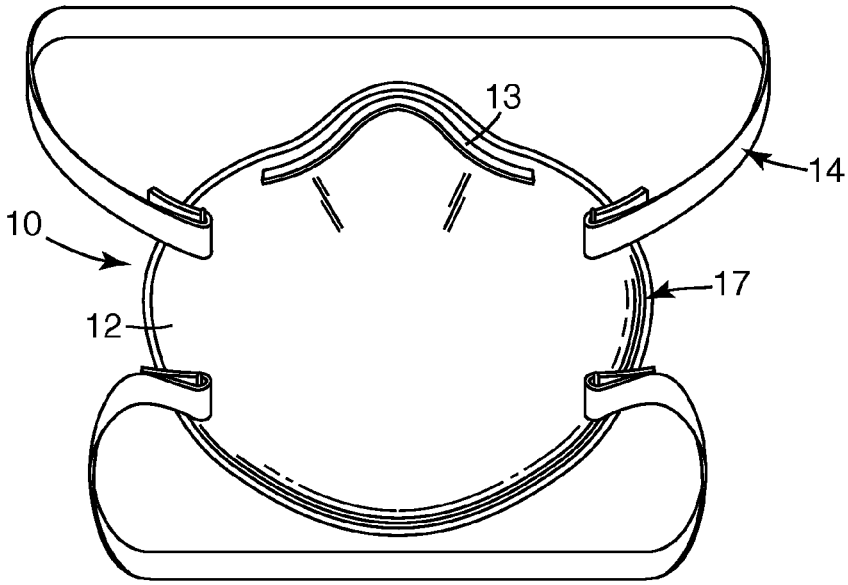
FIG. 1 is a perspective view of a disposable respiratory mask that includes an electret filter media of the invention.

The present inventors have discovered a class of compounds that are capable of enhancing the filtration performance properties of a fibrous filter media when incorporated therein, enhancing the release of a pressure sensitive tape from a substrate made therefrom or both. The class of compounds includes compounds of the formula $$Y^2\text{-}A(R^1)_n\text{—}Y^1 \quad \text{(I)}$$

where A is benzene, naphthalene or anthracene, $Y^1$ and $Y^2$ are each independently $R^2$-$R^3$, $R^2$ is an ester linking group or an amide linking group, $R^3$ is a straight chain alkyl group having from 10 to 22 carbon atoms, $R^1$ is $R^2$-$R^3$ where $R^2$ and $R^3$ are each independently as defined above, and when A is benzene, n is from 0 to 4, when A is naphthalene, n is from 0 to 6, and when A is anthracene, n is from 0 to 8.

The ester linking groups of $R^2$ can be, independent of one another, —OCO— and —COO—.

The amide linking groups of $R^2$ can be, independent of one another, —CONH— and —NHCO—.

The alkyl groups of $R^3$ preferably have from 12 to 22, from 16 to 22, or even from 18 to 22 carbon atoms and are preferably in the form of a straight chain.

Preferably $Y^2$ and $Y^1$ are located ortho, meta or para to each other or even meta or para to each other, when the linking group is an ester, the $Y^2$ and $Y^1$ are preferably located ortho, meta, or para to each other, and when the linking group is an amide, the linking groups are preferably located meta or para to each other.

Examples of useful compounds according to Formula (I) include

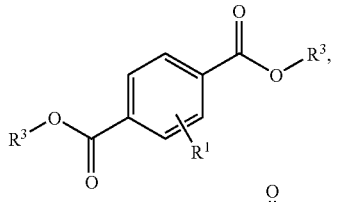

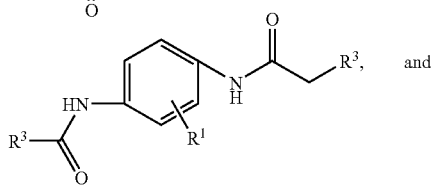

and

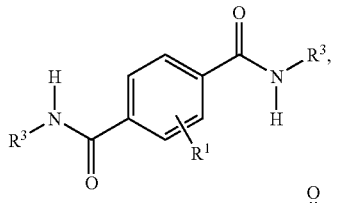

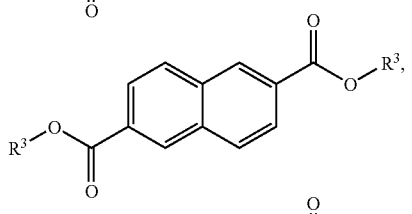

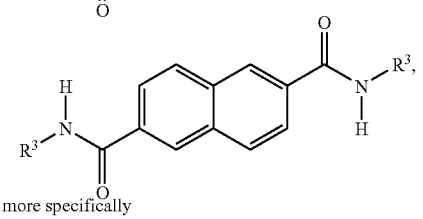

and more specifically

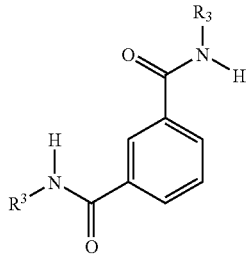

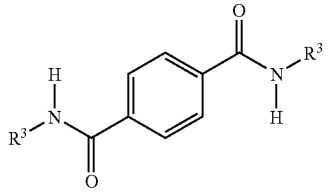

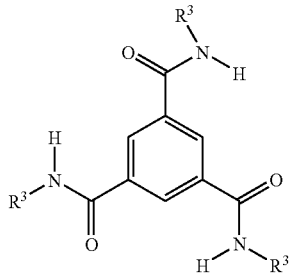

Specific examples of useful compounds of formula (I) include

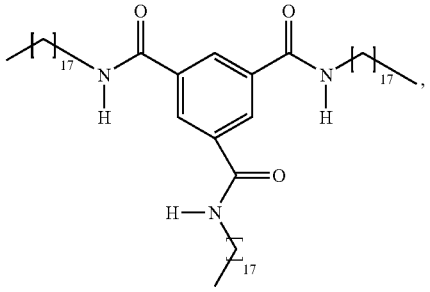

i.e., benzene-1,3,5-tricarboxylic acid tris-octadecylamide,

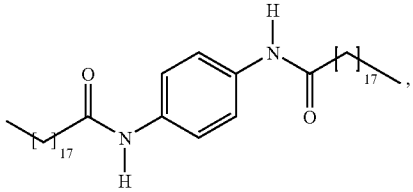

i.e., p-phenylene distearylamide,

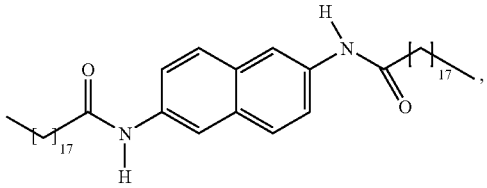

i.e., distearyl 2,6-naphthalenedicarboxylate, and

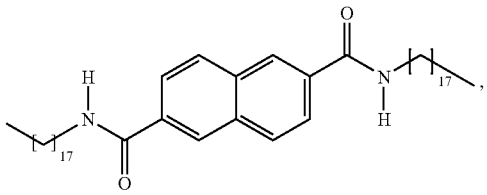

i.e., 2,6-naphthalene distearamide.

Preferred compounds for use in electret filter media are sufficiently stable under fiber forming and web forming process conditions including, e.g., upon exposure to temperatures of at least 150° C., at least 200° C., at least 230° C. or even from about 150° C. to about 330° C.

Useful fibrous electret filter media are prepared from a thermoplastic composition that includes a blend (e.g., a homogenous blend) of a compound of formula (I) and a thermoplastic resin. The compound of formula (I) is preferably present in the thermoplastic composition in an amount of from about 0.1% by weight to 10% by weight, from about 0.2% by weight to 5% by weight, or even from about 0.5 to about 2% by weight.

Useful thermoplastic resins include any thermoplastic non-conductive polymer capable of having a high quantity of trapped charge when formed into a fibrous web and impinged with jets of water or a stream of water droplets. The thermoplastic resin used to form the fibers should be substantially free of materials such as antistatic agents that could increase the electrical conductivity or otherwise interfere with the ability of the fibers to accept and hold electrostatic charges. Preferably the thermoplastic resin is nonconductive, i.e., has a resistivity of greater than $10^{14}$ ohm-cm, and is capable of having a high quantity of trapped charge. A method for determining the ability of a resin to have a high quantity of trapped charge includes forming a nonwoven web from the resin, measuring the filtration performance of the web prior to impingement of jets of water or a stream of water droplets, treating the web by impinging jets of water or a stream of water droplets on the web, drying the web, and then measuring the filtration performance of the treated web. An increase in filtration performance is indicative of trapped charge.

Examples of useful thermoplastic polymers capable of acquiring a trapped charge include polyolefins including, e.g., polypropylene, polyethylene, poly-(4-methyl-1-pentene), and combinations thereof, halogenated vinyl polymers (e.g., polyvinyl chloride), polystyrene, polycarbonates, polyesters, and combinations thereof, and copolymers formed from at least one of polypropylene, 4-methyl-1-pentene, and combinations thereof.

Various additives can be blended in the thermoplastic composition including, e.g., pigments, UV stabilizers, antioxidants, and combinations thereof.

The blend of thermoplastic resin and the additive can be prepared using any suitable method. The resin and the additive can be preblended and pelletized and then the pellets can be melt extruded. Alternatively or in addition, the additive can be blended with the resin in the extruder and then melt extruded. Useful extrusion conditions are generally those that are suitable for extruding the resin without the additive.

The blended mixture is then formed into fibers and a fibrous web using any suitable technique. Fibrous webs can be made from a variety of fiber types including, e.g., meltblown microfibers, staple fibers, fibrillated films, and combinations thereof, using a variety of techniques including, e.g., air laid processes, wet laid processes, hydro-entanglement, spunbond processes, melt blown processes, and combinations thereof. Useful methods of forming fibrous webs are described, e.g., in U.S. Pat. No. 6,827,764 (Springett et al.) and U.S. Pat. No. 6,197,709 (Tsai et al). A useful method of forming meltblown microfibers is described in Wente, Van A., "Superfine Thermoplastic Fibers," *Industrial Eng. Chemistry*, Vol. 48, pp. 1342-1346 and in Report No. 4364 of the Naval Research laboratories, published May 25, 1954, entitled, "Manufacture of Super Fine Organic Fibers," by Wente et al. Meltblown microfibers preferably have an effective fiber diameter in the range of from less than 1 μm to 50 μm as calculated according to the method set forth in Davies, C. N., "The Separation of Airborne Dust and Particles," Institution of Mechanical Engineers, London, Proceedings 1B, 1952.

The presence of staple fibers provides a loftier, less dense web than a web constructed solely of meltblown microfibers. A useful web for an electret includes no more than about 90% by weight staple fibers, or even no more than about 70% by weight staple fibers. Webs containing staple fibers are disclosed in U.S. Pat. No. 4,118,531 (Hauser).

The fibers can be formed from a single resin, a resin blend, a number of resins in a layered configuration (e.g., a core/sheath configuration), and combinations thereof.

Electrets that include a nonwoven polymeric fibrous web preferably have a basis weight of at least about 2 grams per square meter ($g/m^2$), in the range of from about 10 $g/m^2$ to about 500 $g/m^2$, or even from about 10 $g/m^2$ to about 150 $g/m^2$. The thickness of the nonwoven polymeric fibrous web is preferably from about 0.25 mm to about 20 mm, or even from about 0.5 mm to 2 mm.

The nonwoven polymeric webs of the electret can also include particulate matter as disclosed, for example, in U.S. Pat. No. 3,971,373 (Braun), U.S. Pat. No. 4,100,324 (Anderson), and U.S. Pat. No. 4,429,001 (Kolpin et al.).

Charging the fibers to produce an electret article can be accomplished using a variety of techniques including, e.g., hydrocharging, i.e., contacting the fibers with water in a manner sufficient to impart a charge to the fibers, followed by drying the article, and DC corona charging. One example of a useful hydrocharging process includes impinging jets of water or a stream of water droplets onto the article at a pressure and for a period sufficient to impart a filtration enhancing electret charge to the web, and then drying the article. The pressure necessary to optimize the filtration enhancing electret charge imparted to the article will vary depending on the type of sprayer used, the type of polymer from which the article is formed, the type and concentration of additives to the polymer, and the thickness and density of the article. Pressures of from about 10 psi to about 500 psi (69 kPa to 3450 kPa) may be suitable. The jets of water or stream of water droplets can be provided by any suitable spray device. One example of a useful spray device is the apparatus used for hydraulically entangling fibers. An example of a suitable method of hydrocharging is described in U.S. Pat. No. 5,496,507 (Angadjivand et al.). Other methods are described in U.S. Pat. No. 6,824,718 to Eitzman et al., U.S. Pat. No. 6,743,464 to Insley et al., U.S. Pat. No. 6,454,986 to Eitzman et al., U.S. Pat. No. 6,406,657 to Eitzman et al., and U.S. Pat. No. 6,375,886 to Angadjivand et al.

Examples of suitable DC corona discharge processes are described in U.S. Pat. Re. 30,782 (van Turnhout), U.S. Pat. Re. 31,285 (van Turnhout), U.S. Pat. Re. 32,171 (van Turnhout), U.S. Pat. No. 4,375,718 (Wadsworth et al.), U.S. Pat. No. 5,401,446 (Wadsworth et al.), U.S. Pat. No. 4,588,537 (Klasse et al.), and U.S. Pat. No. 4,592,815 (Nakao).

The fibrous electrets preferably exhibit good filtering performance properties. One measure of filter performance is how well a fibrous electret maintains its Quality Factor during challenge with an aerosol. The Quality Factor can be calculated from results obtained from the dioctylphthalate ("DOP") initial penetration test ("the DOP test"). The DOP test also provides a relative measure of the charge state of the filter. The DOP test procedure involves forcing DOP aerosol at a face velocity of 6.9 cm/second for a period of about 30 seconds through the sample, measuring the pressure drop across the sample (Pressure Drop measured in $mmH_2O$) with a differential manometer, and measuring the percent DOP penetration (DOPPen %). The Quality Factor (QF) (measured in $1/mmH_2O$) can be calculated from these values according to the following formula:

$$QF[1/\mathrm{mmH_2O}] = \frac{-\mathrm{Ln}\frac{DOPPenetration(\%)}{100}}{PressureDrop[\mathrm{mmH_2O}]}$$

The higher the Quality Factor at a given flow rate, the better the filtering performance of the electret. The fibrous electrets preferably exhibit an initial quality factor ($Q_0$) of at least 0.6/mm$H_2O$ or even at least 1.2/mm$H_2O$, and a quality factor after accelerated aging ($Q_3$) of at least 0.5/mm$H_2O$ or even at least 1/mm$H_2O$.

An electret in the form of a film can also be formed from the above-described thermoplastic compositions (e.g., a blend of an above-described thermoplastic resin and at least one compound of formula (I)). The thermoplastic resins and methods of charging set forth above are also well suited to forming an electret film and are incorporated herein. An example of a useful method for measuring the charged nature of an electret film is surface potential. Preferably electret films exhibit a surface potential with an absolute value greater than 50 millivolts (mV), greater than 100 mV, greater than 200 mV, greater than 400 mV, or even greater than 500 mV. Electret films are useful in a variety of applications including, e.g., piezoelectric films.

The compounds of formula (I) are also well suited for use in generating release surfaces. A release surface is a surface of an article, preferably a film, that exhibits low adhesion to an adhesive, e.g., a pressure sensitive adhesive. The term "low adhesion" refers to a degree of adhesion that allows separation to occur between the adhesive and the release surface interface. In many tape applications, a release surface is combined with at least one other substrate and an adhesive. This release substrate is often referred to as a low adhesion backsize or LAB. LABs typically have a release force value of less than about 50 N/dm. LABs are well suited to adhesive tape in roll form, where usage requires unwinding the tape from the roll.

The release surface is prepared from a composition that includes a thermoplastic resin and the compound of formula (I). Thermoplastic resins useful for forming release surfaces include, e.g., ethylene vinyl copolymers, modified ethylene vinyl acetate copolymers, polyolefins (e.g., polypropylene, polyethylene, polybutylene, poyl-4-methylpenetene), polyamides (e.g., nylon), polystyrene, polyester, copolyester, polyvinyl chloride, polyvinyl acetate, copolymers of ethylene and propylene, propylene and butylene, and ethylene and butyl acrylate, thermoplastic rubber block copolymers including styrene-butadiene-styrene, styrene-isoprene-styrene, styrene-ethylene-butadiene-styrene, and styrene-ethylene-propylene-styrene, and blends thereof. Any suitable method can be used to prepare the release surface composition including, e.g., melt blending, solvent blending, physical blending (e.g., stirring, and agitating), and combinations thereof.

The release surface composition preferably includes a compound according to formula (I) in an amount of at least about 0.05% by weight, at least about 0.1% by weight from about 0.1% by weight to about 2.0% by weight, from about 0.1% by weight to about 1.0% by weight, or even about 0.5% by weight.

The release surface composition can also include a variety of other components including, e.g., UV stabilizers.

The release surface can be formed using any suitable technique for forming a film including, e.g., extrusion.

The release surface can be provided in a variety of forms including, e.g., a low adhesion backsize for pressure sensitive adhesive tapes (e.g., rolls of single sided tape). Examples of substrates on which the release composition can be applied include thermoplastic polymers, non-thermoplastic polymers, metals, cloth, woven webs, non-woven webs, foam, ceramic, paper, and combinations thereof.

A particularly useful procedure for preparing the compounds represented by formula (I) and including ester linking groups proceeds according to the following Scheme I

I

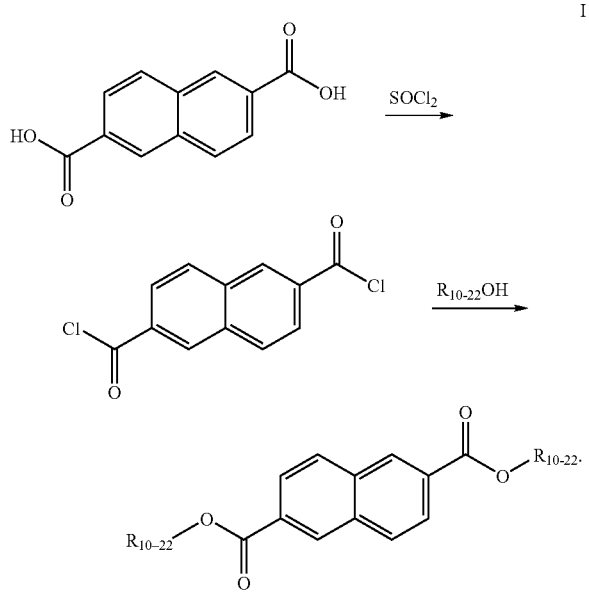

The process includes reacting carboxylic acid groups present on an aromatic compound (e.g., benzene, naphthalene, or anthracene) with thionyl chloride under reflux conditions at a temperature and for a period sufficient to allow substitution of the hydroxyl groups with the halogen atom to form the acid halide. The resulting composition is then cooled and excess thionyl chloride is evaporated. The compound is then suspended in a suitable nonhydroxylic solvent (e.g., hexane, toluene, ethyl acetate and chloroform), and evaporated to dryness to obtain the acid halide. The acid halide is then combined with a straight chain alcohol having from 10 to 22 carbon atoms under conditions of high heat and stirring for a period sufficient to maximize the replacement of chlorine groups with alkoxygroups to form the ester. Useful straight chain alcohols include stearyl alcohol, behenyl alcohol, and palmitic alcohol. The compound is then recrystallized from a suitable solvent (e.g., isopropyl alcohol).

A particularly useful procedure for preparing compounds represented by formula (I) and including an amide linking group proceeds according to the following Scheme II,

II

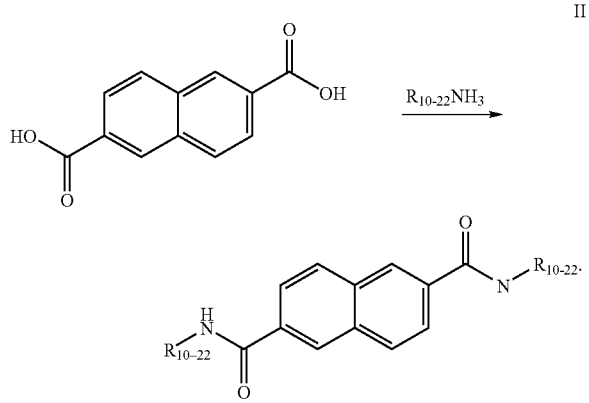

The process includes contacting an aromatic compound (e.g., benzene, naphthalene or anthracene) having at least two alkyl carboxylate groups with a straight chain alkylamine having from 10 to 22 carbon atoms in a resin flask equipped with a mechanical stirrer, and stirring the mixture at an appropriate elevated temperature for a period sufficient to replace the alkoxyl groups with alkyl amine groups (e.g., 210° C. for 5½ hours). The resulting product is cooled to room temperature and recrystallized from a suitable organic solvent (e.g., xylene) to form a thick slurry, which is then diluted with isopropyl alcohol, collected in a Buchner funnel, and washed with a suitable solvent (e.g., isopropyl alcohol). The solid product is then dried under heat and vacuum.

The electrets formed by the methods described herein are suitable in a variety of applications including, e.g., as electrostatic elements in electro-acoustic devices such as microphones, headphones and speakers, fluid filters, dust particle control devices in, e.g., high voltage electrostatic generators, electrostatic recorders, respirators (e.g., prefilters, canisters and replaceable cartridges), heating, ventilation (e.g., in vehicles and buildings (e.g., homes, office buildings and apartment buildings)), air conditioning, and face masks. The inventive electret filter media is particularly suitable for use as a fibrous air filter medium in a respirator. The fibrous filter media also may be used in a filter cartridge that is attached (removably or otherwise) to a face piece (see, for example, U.S. Pat. No. 6,895,960 to Fabin, U.S. Pat. No. 6,883,518 to Mittelstadt et al., and U.S. Pat. No. 6,874,499 to Viner et al.), or it can be used as one or more layers in a mask body that fits over the nose and mouth of a person (see, for example, U.S. Pat. No. 6,923,182 to Angadjivand et al., U.S. Pat. No. 6,886,563 to Bostock et al., U.S. Pat. No. 5,307,796 to Kronzer et al., U.S. Pat. No. 4,827,924 to Japuntich, U.S. Pat. No. 4,807,619 to Dyrud et al., and U.S. Pat. No. 4,536,440 to Berg).

FIG. 1 illustrates an example of a filtering face mask 10 that may be constructed to include the electret filter media. The generally cup-shaped body portion 12 is adapted to fit over the nose and mouth of the wearer. The body portion 12 is porous so that inhaled air can pass through it. The electret filter media is disposed in the mask body 12 (typically over substantially the whole surface area) to remove contaminants from the inhaled air. A conformable nose clip 13 may be placed on the mask body to assist in maintaining a snug fit over the wearer's nose. The nose clip can be an "M shaped" clip as described in U.S. Pat. Des. 412,573 and 5,558,089 to Castiglione. A strap or harness system 14 may be provided to support the mask body 12 on the wearer's face. Although a dual strap system is illustrated in FIG. 1, the harness 14 may employ only one strap 16, and it can come in a variety of other configurations including, e.g., those configurations disclosed in U.S. Pat. No. 4,827,924 to Japuntich et al., U.S. Pat. No. 5,237,986 to Seppalla et al., and U.S. Pat. No. 5,464,010 to Byram. An exhalation valve can be mounted to the mask body to rapidly purge exhaled air from the mask interior. Examples of useful exhalation valves are disclosed in U.S. Pat. Nos. 5,325,892, 5,509,436, 6,843,248, and 6,854,463 to Japuntich et al., and RE37,974 to Bowers.

Figure 2:
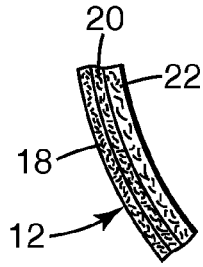
FIG. 2 is a cross-sectional view of the body of the respiratory mask of FIG. 1.

FIG. 2 illustrates an example of a cross-section of a mask body 12. Mask body 12 can have a plurality of layers, as indicated by numerals 18, 20, and 22. The electret filter media can be supported by other layers, such as shaping layers that are made from thermally bonded fibers, such as bicomponent fibers that have an outer thermoplastic component that enables the fibers to bond to other fibers at points of fiber intersection. Layer 18 can be an outer shaping layer, layer 20 can be a filtration layer, and layer 22 can be an inner shaping layer. Shaping layers 18 and 22 support filtration layer 20 and provide shape to mask body 12. At least one of the layers 18, 20, 22 of the mask body includes the electret filter media. Although the term "shaping layers" is used in this description, shaping layers also have other functions, which in the case of an outermost layer can even be a primary function, such as protection of the filtration layer and prefiltration of a gaseous stream. Also, although the term "layer" is used, one layer may include several sublayers, assembled to obtain desired thickness or weight. In some embodiments only one, generally inner, shaping layer is included in a face mask, but shaping can be accomplished more durably and conveniently if two shaping layers are used, for example, one on each side of the filtration layer as shown in FIG. 2. Shaping layer are described in, e.g., U.S. Pat. No. 4,536,440 to Berg, U.S. Pat. No. 4,807,619 to Dyrud et al., U.S. Pat. No. 5,307,796 to Kronzer et al., U.S. Pat. No. 5,374,458 to Burgio, and U.S. Pat. No. 4,850,347 to Skov. Although the illustrated mask body shown in FIGS. 1 and 2 has a generally round, cup-shaped configuration, the mask body can have other shapes as described in, e.g., U.S. Pat. No. 4,883,547 to Japuntich.

Figure 3:
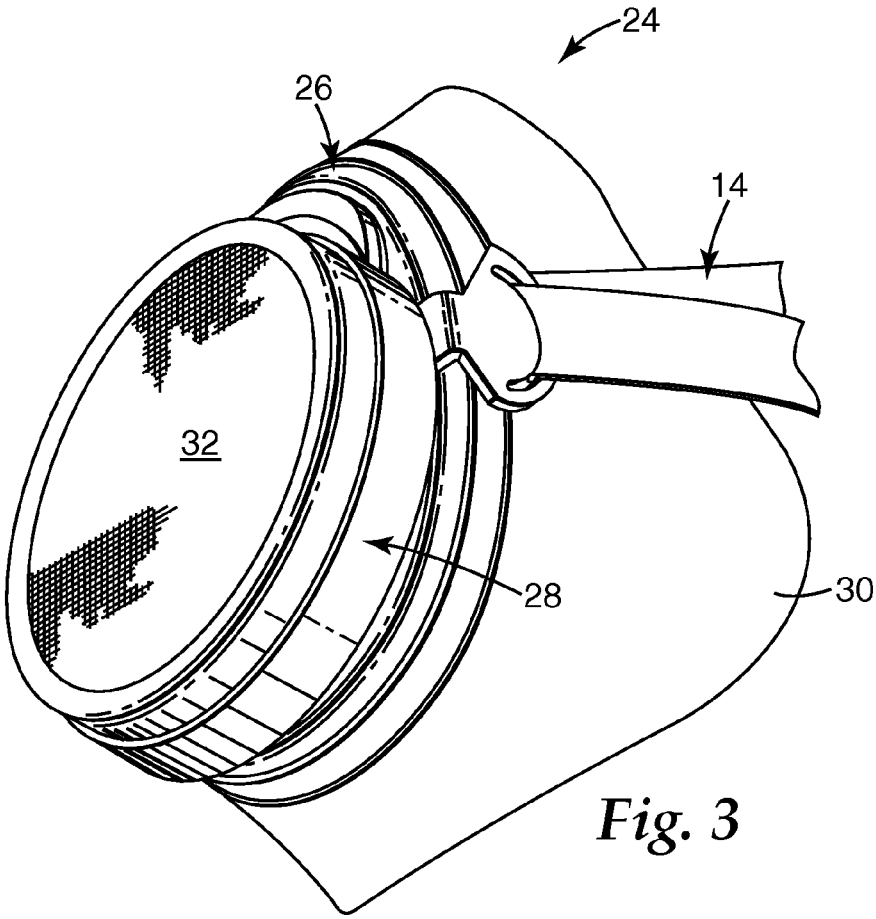
FIG. 3 is a perspective view of a respiratory mask that has a filter cartridge that includes an electret filter media of the invention.

FIG. 3 illustrates a respirator 24 that includes a filter that includes an electret article. Respirator 24 includes an elastomeric mask body 26 that has a filter cartridge 28 secured to it. Mask body 26 typically includes an elastomeric face piece 30 that conformably fits over the nose and mouth of a person. The filter cartridge 28 contains the electret filter media for capturing contaminants before they are inhaled by the wearer. The filter element can include the electret filter article by itself or in conjunction with other filters including, e.g., a gaseous filter such as an activated carbon bed. A porous cover or screen 32 can be provided on the filter cartridge to protect the external surface of the filter element. Examples of other filter cartridges in which the electret filter media can be used include the filter cartridges disclosed in U.S. Pat. No. Re. 35,062 to Brostrom et al. or in U.S. Pat. No. 5,062,421 to Burns and Reischel. Multiple filter cartridges can be used in the same respirator. The cartridges also can be removable and replaceable. The filter media can also be used in the filter cartridges of powered air purifying respirators (PAPRs). Examples of PAPRs are shown in U.S. Pat. No. 6,666,209 to Bennett et al. and U.S. Pat. No. 6,575,165 to Cook et al. The filter media can also be used in filter cartridges for escape hoods examples of which are disclosed in U.S. Pat. No. D480,476 to Martinson et al., and U.S. Pat. Nos. 6,302,103, 6,371,116, and 6,701,925 to Resnick.

Figure 4:
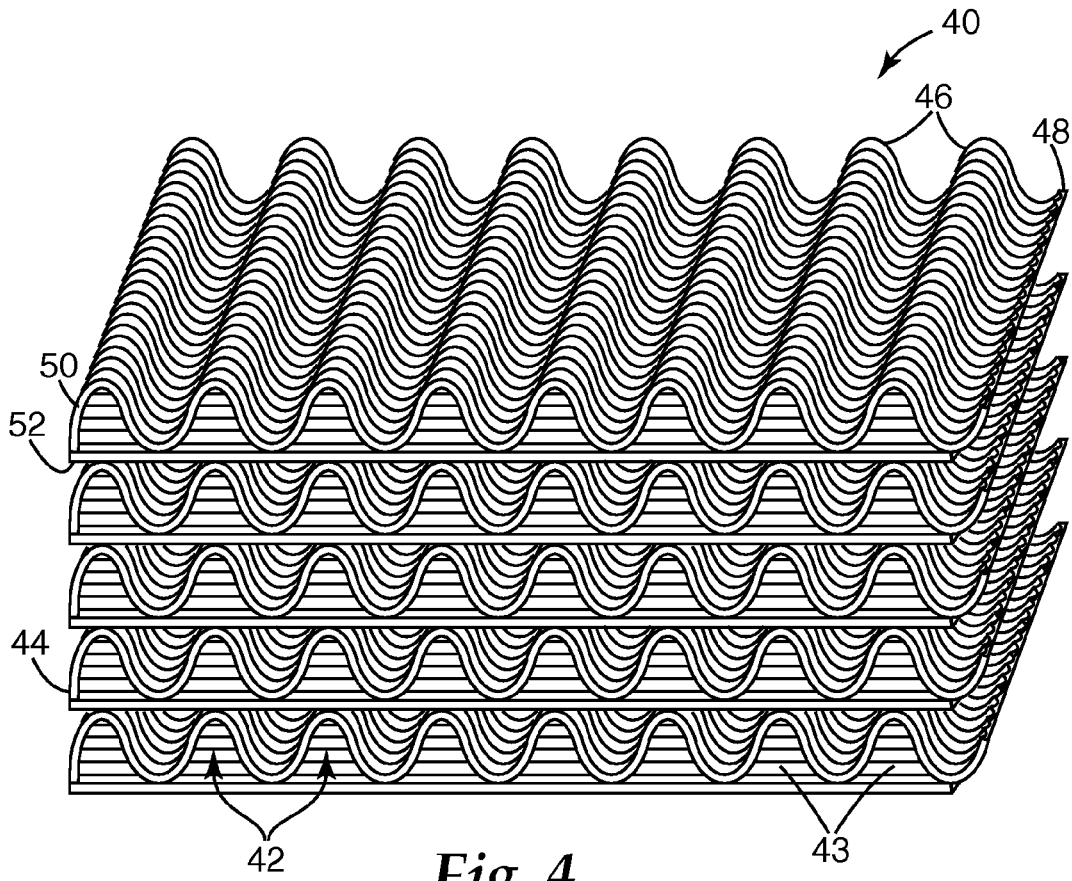
FIG. 4 is a perspective view of an electret filtration media array.

FIG. 4 shows a perspective view of a filtration media array 40. The structure of the array 40 includes multiple flow channels 42 that define inlets 43 on a first side 44 of the array 40 and have outlets 46 on a second side of the array 48. The flow channels can be defined by a corrugated or microstructured layer 50 and a cap layer 52. The contoured layer 50 can be joined to the cap layer 52 at one or more peaks or valleys. By stacking multiple layers of structured and planar members, a microchanneled arrangement can be achieved. The flow channels tend to have a high aspect ratio, and the film layers are preferably electrically charged to provide the article 40 with good capture efficiency. The pressure drop across the array 40 from first side 44 to second side 48 is negligible. At least one of the layers of the array includes the electret filter media. Examples of non-fibrous electret articles are disclosed in U.S. Pat. No. 6,7532,889 (Insley et al.), U.S. Pat. No. 6,280,824 (Insley et al.), U.S. Pat. No. 4,016,375 (Van Turnout) and U.S. Pat. No. 2,204,705 (Rutherford).

The invention will now be described by way of the following examples. Unless otherwise specified, all percentages are by weight.

EXAMPLES

Test Procedures

Test procedures used in the examples include the following.

Effective Fiber Diameter

Effective geometric fiber diameters are evaluated according to the method set forth in Davies, C. N., "The Separation of Airborne Dust and Particles," Institution of Mechanical Engineers, London, Proceedings 1B, 1952.

Initial Dioctylphthalate Penetration (DOP) and Pressure Drop Test Procedure

The filtration performance of blown microfiber webs are evaluated using a TSI 8130 automatic filter tester using dioctylphthalate (DOP) as the challenge aerosol and a MKS pressure transducer that measure pressure drop (DP) through the filter (DP-mm$H_2O$).

Initial DOP penetration is determined by forcing 0.3 micrometer diameter dioctyl phthalate (DOP) particles at a concentration of from 70 mg/$m^3$ to 140 mg/$m^3$ (generated using a TSI No. 212 sprayer with four orifices and 30 psi clean air) through a sample of filter media which is 4.5 inches in diameter at a rate of 42.5 L/min (a face velocity of 6.9 centimeters per second). The sample is exposed to the DOP aerosol for 30 seconds until the readings stabilize. The penetration is measured with an optical scattering chamber, Percent Penetration Meter Model TPA-8F available from Air Techniques Inc.

Pressure drop across the sample is measured at a flow rate of 42.5 L/min (a face velocity of 6.9 cm/sec) using an electronic manometer. Pressure drop is reported in mm of water ("mm $H_2O$").

DOP penetration and pressure drop are used to calculate the quality factor "QF" from the natural log (ln) of the DOP penetration by the following formula:

$$QF[1/\text{mm}\,H_2O] = \frac{-\text{Ln}\frac{DOPPenetration(\%)}{100}}{PressureDrop[\text{mm}\,H_2O]}$$

A higher initial QF indicates better initial filtration performance. A decreased QF effectively correlates with decreased filtration performance.

DOP Loading Test Procedure

DOP loading is determined using the same test equipment used in the DOP penetration and pressure drop tests. The test sample is weighed and then exposed to the DOP aerosol for at least 45 min to provide a minimum exposure of at least about 130 mg. DOP penetration and pressure drop are measured throughout the test at least as frequently as once per minute. The mass of DOP collected is calculated for each measurement interval from the measured penetration, mass of the filter web, and total mass of DOP collected on the filter web during exposure ("DOP Load").

Surface Potential Test Method

The potential at the surface of a film is measured using a Model 170-3 isoprobe electrometer from Monroe Electronics Inc. (Lyndonville, N.Y.) and a gap of approximately 3 millimeters on a grounded plane.

Accelerated Aging Conditions

The sample is placed in an oven at 71° C. for three days and then removed.

Thermogravimetric Analysis (TGA) at 300° C.

Thermal stability is tested on a 10-15 mg sample of additive on a TA thermogravimetric analysis unit (from TA Instruments, Inc., New Castle, Del.) under nitrogen using a DuPont 2000 operating system. The starting temperature is room temperature and the final temperature is 600° C. using a ramp rate of 10° C./minute

Example 1

Preparative Compound I

To a 250 mL 1 neck round bottom equipped with a reflux condenser and magnetic stirrer was added naphthalene-2,6-dicarboxylic acid (10.00 grams), thionyl chloride (16.00 g) and chloroform (86 mL). The mixture was stirred and heated under reflux for 8 hours. The clear solution was cooled to room temperature and the solvent evaporated in a stream of nitrogen. The resulting solid was suspended in 75 ml of hexane and evaporated to dryness with a rotoevaporater to yield 11.71 grams of the diacid chloride illustrated below as a yellow crystalline solid having the structure

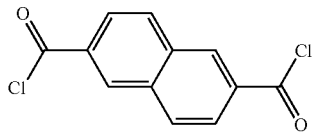

, which was confirmed by infrared spectral analysis.

To Preparative Compound I (11.71 grams) was added stearyl alcohol (26.27 grams) and the contents were heated to 80° C. with magnetic stirring. After five hours the clear molten product was cooled to room temperature. The crude solid product was then recrystallized from isopropyl alcohol (350 mL) and the crystalline solid was collected in a Buchner funnel, washed with methanol, air dried, and then dried in a vacuum oven overnight (under conditions of 1 Torr and 40° C.). The yield was 29.6 g (i.e., 75%). The structure of the product, i.e., distearyl 2,6-naphthalene dicarboxylate was determined to be

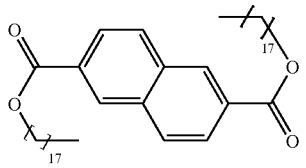

and was confirmed by infrared spectral analysis.

Example 2

To a 500 mL resin flask equipped with a mechanical stirrer was added dimethyl naphthalene-2,6-dicarboxylate (23.77 grams) and stearylamine (55.09 grams). The mixture was stirred and heated to 210° C. for 5½ hours. The resulting crude product was cooled to room temperature and recrystallized from xylene (350 mL). The resulting thick slurry was diluted with isopropyl alcohol (350 mL) collected in a Buchner funnel and washed with isopropyl alcohol. The solid product was dried overnight in a vacuum oven (under conditions of 1 Torr and 40° C.). The yield of the white crystalline product was 48.3 g (i.e., 69%). The structure of the product, i.e., 2,6-naphthalene-distearylamide, was determined to be

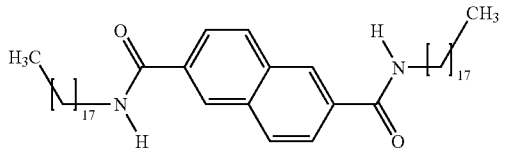

and was confirmed by infrared spectral analysis.

Control and Examples 3-7

Preparation of Blown Microfiber Webs (BMF)

BMF webs were prepared by extruding a thermoplastic blend as described in Van A. Wente, Superfine Thermoplastic Fibers, "Industrial Engineering Chemistry, vol. 48, pp. 1342-1346, using a Brabender-Killion conical twin screw extruder (Brabender Instruments, Inc.) operating at a rate of from about 3.2 kg/hour to about 4.5 kg/hour (7-10 lb/hour) and at an extrusion temperature of from about 280° C. to about 300° C. The thermoplastic blend included EXXON 3505 polypropylene as the base polymer and 1% by weight of one of the additives set forth in Table 1. The resulting web had an effective fiber diameter of from 7 μm to 8 μm and a basis weight of from 46 grams per square meter (g/m$^2$) to 54 g/m$^2$, or from 60 g/m$^2$ to 70 g/m$^2$. The actual effective fiber diameter and basis weight for each web is set forth in Table 1 below.

The web of the control had a basis weight of 60 g/m$^2$.

Hydrocharging Method

The BMF webs prepared as described above were charged by directing a jet of aerosols and streams of water having a pH of from 6 to 7 at the BMF web at a nozzle pressure of 100 pounds per square inch (psig). The webs were placed on a belt that passes through a jet at approximately one inch per second. The sprayed water was rapidly removed through a vacuum nozzle below the media. The web was sprayed with water on both the air and collector sides. The samples were allowed to dry for from 2 hours to 6 hours prior to testing for filter efficiency.

The resulting hydrocharged webs were then tested according to the Initial Dioctylphthalate Penetration (DOP) and Pressure Drop Test Procedure. The results are recorded as $Q_0$ and Pressure Drop, respectively, under in the table below.

A set of the resulting hydrocharged webs was subjected to the Accelerated Aging Conditions and then tested according to the Initial Dioctylphthalate Penetration Test Procedure. The results are recorded as $Q_3$ in the table below.

Other embodiments are within the claims. Unless otherwise defined, all technical and scientific terms used herein have the same meaning as commonly understood by one of ordinary skill in the art to which this invention belongs. All publications, patent applications, patents, and other references cited above are incorporated by reference into this document in total. In case of conflict, the present specification, including definitions, will control.

What is claimed is:

1. An electret filter media comprising a fibrous web that comprises fibers comprising:

thermoplastic resin, and a compound of the formula $$Y^2\text{-}A(R^1)_n\text{—}Y^1 \qquad (I)$$

where A is benzene, naphthalene or anthracene, $Y^1$ and $Y^2$ are each independently $R^2$-$R^3$, $R^2$ is an ester linking group or an amide linking group, $R^3$ is a straight chain alkyl group having from 10 to 22 carbon atoms, $R^1$ is $R^2$-$R^3$, where $R^2$ and $R^3$ are each independently as defined above, and when A is benzene, n is from 0 to 4, when A is naphthalene, n is from 0 to 6, and when A is anthracene, n is from 0 to 8.

2. The electret filter media of claim 1, wherein A is benzene.

3. The electret filter media of claim 2, wherein $R^2$ is —CONH, —NHCO, —OCO or —COO.

4. The electret filter media of claim 3, wherein $R^3$ is an alkyl group having from 12 to 22 carbon atoms.

5. The electret filter media of claim 3, wherein n is 1.

6. The electret filter media of claim 3, wherein n is 1, and $R^1$, $Y^1$ and $Y^2$ are located meta to each other.

7. The electret filter media of claim 3, wherein n is 0 and $Y^1$ and $Y^2$ are located para to each other.

8. The electret filter media of claim 1, wherein A is naphthalene.

9. The electret filter media of claim 8, wherein $R^2$ is —CONH—, —NHCO—, —OCO— or —COO—.

10. The electret filter media of claim 8, wherein $R^3$ is an alkyl group having from 12 to 22 carbon atoms.

11. The electret filter media of claim 8, wherein n is 0, $Y^1$ is located at the 2 position on naphthalene, and $Y^2$ is located at the 6 position on naphthalene.

12. The electret filter media of claim 8, wherein n is 1.

TABLE 1

| Example | Compound | % by Weight Additive | Pressure Drop (mm$H_2O$) | Effective Fiber Diameter (μm) | Basis Wt (g/cm$^2$) | $Q_0$ | $Q_3$ | TGA @ 300° C. |
|---|---|---|---|---|---|---|---|---|
| Control | N/A | 0 | 2.0-2.5 | 7.5-8.5 | 56-62 | 0.5 | 0.4 | N/A |
| 1 | 2,6-naphthalene-distearamide | 1 | 1.8-1.9 | 7.6 | 57 | 0.8-0.9 | 0.85-0.95 | >99.5% |
| 2 | distearyl 2,6-naphthalene dicarboxylate | 1 | 2.2-2.4 | 8.2 | 56 | 1.3 | 0.8-0.9 | 97% |
| 3 | p-phenylene distearylamide | 1 | 1.4-1.5 | 8.5 | 58 | 1.2-1.3 | 1.2-1.3 | 90% |
| 4 | benzene-1,3,5-tricarboxylic acid tris-ocadecylamide | 1 | 1.9-2.0 | 7.8 | 60 | 0.88 | 0.88 | 88.59% |

N/A = not applicable

13. The electret filter media of claim 1, wherein the compound of formula (I) is selected from the group consisting of:

benzene-1,3,5-tricarboxylic acid tris-octadecylamide;

p-phenylene distearylamide;

distearyl-2,6-naphthalenedicarboyxlate; and 2,6-naphthalene distearamide.

14. The electret filter media of claim 1, wherein the thermoplastic resin is selected from the group consisting of polycarbonate, polyolefin, polyester, halogenated polyvinyl, polystyrene, or a combination thereof.

15. The electret filter media of claim 1, wherein the thermoplastic resin is selected from the group consisting of polypropylene, poly-(4-methyl-1-pentene), or a combination thereof.

16. The electret filter media of claim 1, wherein the fibers include meltblown microfibers.

17. An air filter that comprises the electret filter media of claim 1.

18. A respirator that comprises at least one layer of filter media that includes the electret filter media of claim 1.

19. A vehicle ventilation system that comprises at least one layer of filter media that includes the electret filter media of claim 1.

* * * * *